US010780494B2

(12) United States Patent
Choi et al.

(10) Patent No.: US 10,780,494 B2
(45) Date of Patent: Sep. 22, 2020

(54) METHOD FOR MANUFACTURING METALLIC NANOWIRE TRANSPARENT ELECTRODE

(71) Applicants: Samsung Display Co., Ltd., Yongin-si, Gyeonggi-do (KR); KOREA ADVANCED INSTITUTE OF SCIENCE AND TECHNOLOGY, Daejeon (KR)

(72) Inventors: Jin Hwan Choi, Seoul (KR); Jung Yong Lee, Daejeon (KR); Tae Woong Kim, Seongnam-si (KR); Jae Ho Ahn, Daejeon (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 1184 days.

(21) Appl. No.: 15/087,819

(22) Filed: Mar. 31, 2016

(65) Prior Publication Data

US 2017/0157670 A1 Jun. 8, 2017

(30) Foreign Application Priority Data

Dec. 7, 2015 (KR) ..... 10-2015-0173270

(51) Int. Cl.
*B22F 1/00* (2006.01)
*B22F 9/24* (2006.01)

(52) U.S. Cl.
CPC ..... *B22F 1/0025* (2013.01); *B22F 9/24* (2013.01); *B22F 2009/245* (2013.01); *B22F 2301/255* (2013.01); *B22F 2304/05* (2013.01); *B22F 2998/10* (2013.01)

(58) Field of Classification Search
CPC ..... C23C 18/1635; H03K 17/9622; H01L 31/022466; H01B 1/026
USPC ..... 200/600; 174/126.1, 120 C
See application file for complete search history.

(56) References Cited

U.S. PATENT DOCUMENTS 8,618,531 B2 12/2013 Alden et al.
9,530,534 B2 * 12/2016 Hu ..... C23C 18/1635
2013/0008690 A1 * 1/2013 Wiley ..... H01B 1/026 174/120 C (Continued)

FOREIGN PATENT DOCUMENTS

KR 10-2009-0112626 A 10/2009
KR 10-2010-0085383 A 7/2010

(Continued)

OTHER PUBLICATIONS

Ahn et al., "Interlocking and transferring silver nanowire networks via chemical reduction: importance of contact resistance between wires for improved performance and stability," *KAIST EEWS Research Center*, P1(SC)-15, p. 157, disclosed at The Korean Electrochemical Society 2015 Spring Meeting & Conference, Apr. 2, 2015.

(Continued)

*Primary Examiner* — Khanh T Nguyen
(74) *Attorney, Agent, or Firm* — F. Chau & Associates, LLC

(57) ABSTRACT

Disclosed is a method for manufacturing a metallic nanowire transparent electrode, including generating a metallic nanowire and chemically reducing the metallic nanowire to connect adjacent metallic nanowires.

11 Claims, 14 Drawing Sheets

(56) References Cited

U.S. PATENT DOCUMENTS

| | | | | |
|---|---|---|---|---|
| 2013/0087363 | A1* | 4/2013 | Oh | H01L 31/022466 174/126.1 |
| 2014/0090870 | A1 | 4/2014 | Garnett et al. | |
| 2014/0106134 | A1 | 4/2014 | Fu et al. | |
| 2014/0231718 | A1 | 8/2014 | Lin et al. | |
| 2014/0238833 | A1* | 8/2014 | Virkar | H03K 17/9622 200/600 |

FOREIGN PATENT DOCUMENTS

| | | | |
|---|---|---|---|
| KR | 10-2011-0071526 | A | 6/2011 |
| KR | 10-2013-0047243 | A | 5/2013 |
| KR | 10-2013-0064209 | A | 6/2013 |
| KR | 10-2015-0039268 | A | 4/2015 |

OTHER PUBLICATIONS

Lee, Prof. Jung-Yong, Graduate School of EEWS, KAIST, Cover Letter for "Reduction of Metal Nanostructure," manuscripts, Mar. 31, 2015, pp. 1-3.

Ahn et al., "Self-Supplied Nano-Soldering and Exfoliating Metal Nanostructures via Surface Oxide Reduction," *Graduate School of EEWS, KAIST manuscript*, Mar. 31, 2015, pp. 1-27.

Ahn et al., "Supporting Information: Self-Supplied Nano-Soldering and Exfoliating Metal Nanostructures via Surface Oxide Reduction," *Graduate School of EEWS, KAIST manuscript*, Mar. 31, 2015, pp. 1-13.

* cited by examiner

METHOD FOR MANUFACTURING METALLIC NANOWIRE TRANSPARENT ELECTRODE

CROSS-REFERENCE TO RELATED APPLICATION

Any and all applications for which a foreign or domestic priority claim is identified in the Application Data Sheet as filed with the present application are hereby incorporated by reference under 37 CFR 1.57. This application claims priority to and the benefit of Korean Patent Application No. 10-2015-0173270 filed in the Korean Intellectual Property Office on Dec. 7, 2015, the entire contents of which are incorporated herein by reference.

BACKGROUND

Field

The present disclosure relates to a method for manufacturing a metallic nanowire transparent electrode.

Description of the Related Technology

A transparent conductor represents a thin conductive layer coated on a high-transmittance insulating surface or substrate. The transparent conductor may be manufactured to have surface conductivity while maintaining proper optical transparency.

The surface-conductive transparent conductor is widely used as a transparent electrode for a flat liquid crystal display, a touch panel, an electroluminescent device, and a thin film photovoltaic cell, and is generally used as an antistatic layer and an electromagnetic shield layer.

A generally well-known transparent electrode is made of indium doped tin oxide (ITO), and a large number of attempts to use a carbon nanotube, a conductive polymer, or silver nanowire to manufacture the transparent electrode have been performed.

A vacuum deposited metal oxide such as the ITO is an industry standard material for providing optical transparency and electrical conductivity to dielectric surfaces such as glass or polymeric films.

The ITO electrode is widely used in application of transparent electronic elements because of transmittance that is greater than 80% and low sheet resistance characteristic that ranges 10 to 50 Ω/sq. However, there is a difficulty in supplying indium because of limited reserves, unreliable supply and demand, and expense.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

The present disclosure has been made in an effort to provide a method for manufacturing a metallic nanowire transparent electrode.

An exemplary embodiment of the present disclosure provides a method for manufacturing a metallic nanowire transparent electrode, including: generating a metallic nanowire; and chemically reducing the metallic nanowire to connect adjacent metallic nanowires.

A reducing agent used when the metallic nanowire is chemically reduced may be at least one selected from the group consisting of hydrazine, hydroxylamine, and formaldehyde, tetrahydroborates including lithium (Li) tetrahydroborate, including sodium (Na) tetrahydroborate, potassium (K) tetrahydroborate, polyhydroxybenzenes including hydroquinone, alkyl-substituted hydroquinones, and pyrogallol, $LiAlH_4$, phenylenediamines, aminophenols, ascorbic acid, ascorbic acid ketals, 3-pyrazolidinone, hydroxytetronic acid, hydroxytetronamide, bisnaphthols, lithium (Li), sodium (Na), and potassium (K) sulfonamidophenols.

The metallic nanowire may include at least one metal selected from the group consisting of lead (Pb), indium (In), tin (Sn), aluminum (Al), silver (Ag), copper (Cu), gold (Au), platinum (Pt), titanium (Ti), iron (Fe), nickel (Ni), cobalt (Co), and their mixtures.

The metallic nanowire may include silver, a reducing agent used when the metallic nanowire is chemically reduced may be hydrazine, and the reduction time may be about 1 min to 10 min.

The metallic nanowire may include copper, a reducing agent used when the metallic nanowire is chemically reduced may be hydrazine, and the reduction time may be about 20 min to 60 min.

The chemical reduction of the metallic nanowire may be performed by reacting with the metallic nanowire while a reducing agent is vaporized.

The chemical reduction of the metallic nanowire may be performed by soaking the metallic nanowire in a reducing agent in a solution state.

The method may further include, the step of depositing the metallic nanowire on a substrate before generating of a metallic nanowire and the chemical reduction of the metallic nanowire to connect adjacent metallic nanowires.

The method may further include, after chemical reduction of the metallic nanowire to connect adjacent metallic nanowires, soaking the metallic nanowire in water to separate the substrate and the metallic nanowire deposited on the substrate.

The method may further include, after soaking the metallic nanowire into water to separate the substrate and the metallic nanowire deposited on the substrate, transferring the separated metallic nanowire onto a material.

After chemical reduction of the metallic nanowire to connect adjacent metallic nanowires, transmittance of the metallic nanowire transparent electrode may be greater than 80% in a visible ray region.

According to an exemplary embodiment of the present disclosure, the decrease of sheet resistance by oxidation and deterioration of transparency may be prevented by chemical reduction of the metallic nanowire.

DETAILED DESCRIPTION OF CERTAIN INVENTIVE EMBODIMENTS

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

A method for manufacturing a metallic nanowire transparent electrode according to an exemplary embodiment of the present disclosure will now be described in detail with reference to accompanying drawings.

Figure 1:
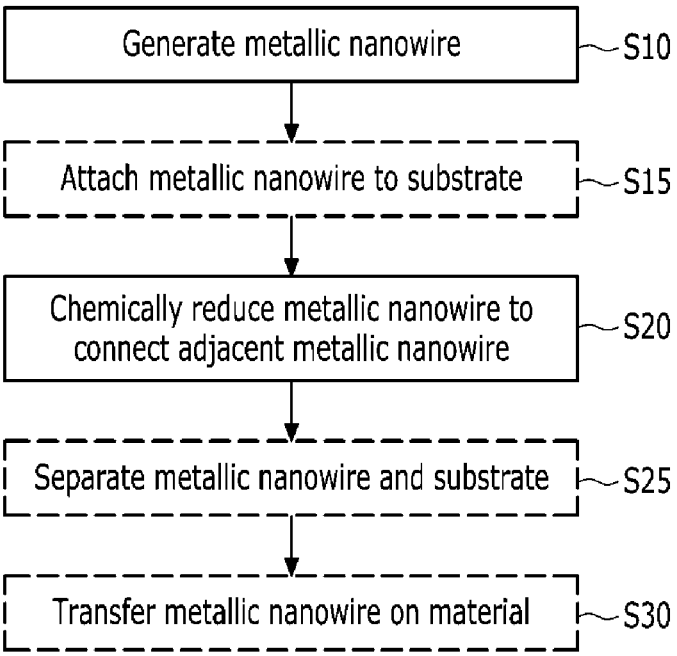
FIG. 1 shows a flowchart of a method for manufacturing a metallic nanowire transparent electrode according to an exemplary embodiment of the present disclosure.

FIG. 1 shows a flowchart of a method for manufacturing a metallic nanowire transparent electrode according to an exemplary embodiment of the present disclosure.

Referring to FIG. 1, the method for manufacturing a metallic nanowire transparent electrode according to an exemplary embodiment of the present disclosure includes generating a metallic nanowire (S10), and chemically reducing the metallic nanowire to connect an adjacent metallic nanowire (S20).

A metal oxide such as the indium doped tin oxide (ITO) is used as a conventional transparent electrode, and it is difficult to supply the ITO because of limited reserves of indium. The method for manufacturing a metallic nanowire transparent electrode according to an exemplary embodiment of the present disclosure may replace the conventionally used ITO by manufacturing the transparent electrode of a metallic nanowire.

Regarding the method for manufacturing a metallic nanowire transparent electrode according to an exemplary embodiment of the present disclosure, a metallic nanowire is generated. The metallic nanowire may have a diameter of 30 nm to 50 nm and a length of 15 μm to 40 μm. When metallic nanowires with the above-noted thickness are connected to configure an electrode, the electrode is transparent because of its thinness.

In some embodiments, the metallic nanowire may include at least one metal selected from the group consisting of lead (Pb), indium (In), tin (Sn), aluminum (Al), silver (Ag), copper (Cu), gold (Au), platinum (Pt), titanium (Ti), iron (Fe), nickel (Ni), cobalt (Co), and their mixtures.

In some embodiments, the metallic nanowire may be a mixture of at least one metal selected from the group selected from the group consisting of lead (Pb), indium (In), tin (Sn), aluminum (Al), silver (Ag), copper (Cu), gold (Au), platinum (Pt), titanium (Ti), iron (Fe), nickel (Ni), cobalt (Co), and their mixtures, and a nonmetal.

In some embodiments, the metallic nanowire may have a shape such as a metal network or a metal mesh by etching a metallic thin film made of at least one metal selected from the group selected from the group consisting of lead (Pb), indium (In), tin (Sn), aluminum (Al), silver (Ag), copper (Cu), gold (Au), platinum (Pt), titanium (Ti), iron (Fe), nickel (Ni), cobalt (Co), and their mixtures.

The method for manufacturing a metallic nanowire transparent electrode according to an exemplary embodiment of the present disclosure may include depositing or coating the metallic nanowire on the substrate (S15). When the metallic nanowire is deposited or coated on the substrate, a chemical reduction is performed in the subsequent stage.

The metallic nanowire is chemically reduced to connect with the adjacent metallic nanowire. By the chemical reduction and the connection of a metallic nanowire, high conductivity can be achieved and sheet resistance may be decreased. The mutually connected metallic nanowires may improve chemical stability without an optical loss.

In general, to manufacture the transparent electrode with a metallic nanowire, a process for controlling the respective metallic nanowires to contact each other through heat treatment, pressurization, mixing of another material, or coating, and improving stability in the air, is required.

However, when the metallic nanowires are connected to each other through heat treatment, the substrate may be melted by the heat treatment. When the metallic nanowires are connected to each other through pressurization, the substrate may be damaged by the pressure. When the metallic nanowires are connected to each other through mixing with another material, transmittance of the transparent electrode may be reduced by the mixed material.

However, the method for manufacturing a metallic nanowire transparent electrode according to an exemplary embodiment of the present disclosure connects the metallic nanowires that are chemically reduced and are adjacent.

A reducing agent used in a current stage may be at least one selected from the group consisting of hydrazine, hydroxylamine, and formaldehyde, tetrahydroborates including lithium (Li) tetrahydroborate, sodium (Na) tetrahydroborate, potassium (K) tetrahydroborate, polyhydroxybenzenes including hydroquinone, alkyl-substituted hydroquinones, and pyrogallol, $LiAlH_4$, phenylenediamines, aminophenols, ascorbic acid, ascorbic acid ketals, 3-pyrazolidinone, hydroxytetronic acid, hydroxytetronamide, bisnaphthols, sulfonamidophenols, lithium (Li), sodium (Na), and potassium (K) sulfonamidophenols.

Here, tetrahydroborate including lithium (Li) is expressed as a formula of $LiBH_4$, tetrahydroborate including sodium (Na) is expressed as a formula of $NaBH_4$, and tetrahydroborate including potassium (K) is expressed as a formula of $KBH_4$.

Regarding the method for manufacturing a metallic nanowire transparent electrode according to an exemplary embodiment of the present disclosure, the reduction may be performed in various states.

In some embodiments, the method for manufacturing a metallic nanowire transparent electrode according to an exemplary embodiment of the present disclosure, the reduction may be performed by vaporizing the selected reducing agent and allowing the same to react with the metallic nanowire.

In some embodiments, the method for manufacturing a metallic nanowire transparent electrode according to an exemplary embodiment of the present disclosure, the reduction may be performed by manufacturing the selected reducing agent in a liquid state and soaking the metallic nanowire in the liquid.

In some embodiments the metallic nanowires are manufactured and the metallic nanowires are allowed to react with the reducing agent and connect to each other, and it is also allowable in the exemplary embodiment of the present disclosure to put the reducing agent into the metallic nanowire solution and reduce the same in advance before the metallic nanowires are manufactured.

In some embodiments of the present disclosure, silver may be used as the metallic nanowire, and $N_2H_2$ may be used as the reducing agent. In the manufacturing method, the metallic nanowires are reduced according to a following reaction formula. For example, a silver oxide nanowire reacts with the reducing agent to become silver, and during this reduction process, adjacent nanowires are bonded.

$$2Ag_2O+N_2H_4 \rightarrow 4Ag+N_2+2H_2O$$

Figure 2:
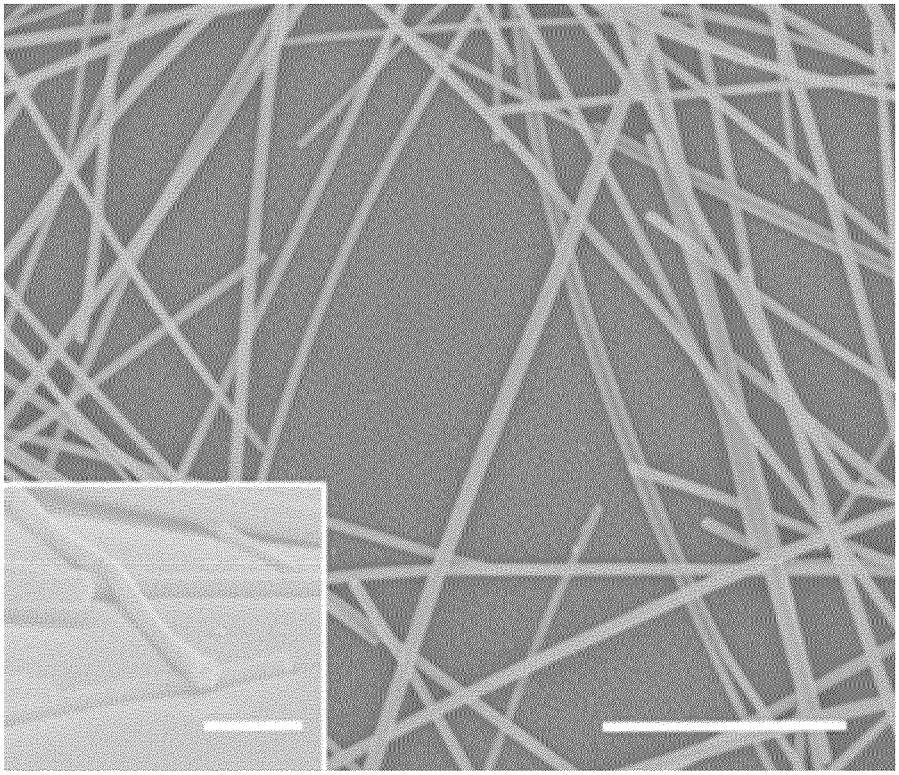
FIG. 2 shows an image before a metallic nanowire is reduced.
Figure 3:
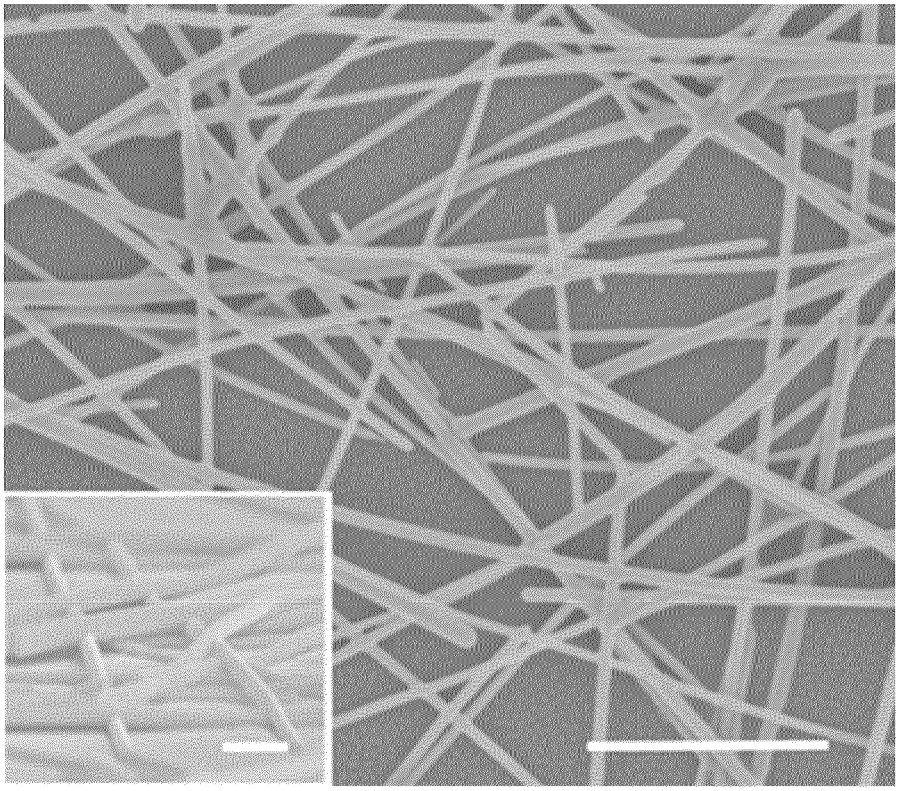
FIG. 3 shows an image after a metallic nanowire is reduced according to an exemplary embodiment.

As a result of the reduction, the adjacent metallic nanowires are connected to each other. FIG. 2 shows an image before a metallic nanowire is reduced, and FIG. 3 shows an image after a metallic nanowire is reduced according to an exemplary embodiment of the present disclosure.

Referring to FIG. 2, the metallic nanowires are not connected to each other but overlap each other before the chemical reduction according to an exemplary embodiment of the present disclosure. However, it is determined after the chemical reduction that the metallic nanowires are connected to each other as shown in FIG. 3.

Therefore, the manufactured metallic nanowires may be connected to each other and may be used as electrodes. When the metallic nanowires are connected to each other, high conductivity may be obtained and sheet resistance may be decreased. The mutually connected nanowires may improve chemical stability without causing an optical loss.

The conventional reduction method may decrease transmittance of the metallic nanowire by the coating of a reduction material after the reduction treatment, or may damage the substrate by heat or pressure generated for connection of the metallic nanowires. However, the method for manufacturing a metallic nanowire transparent electrode according to an exemplary embodiment of the present disclosure may provide the electrode with excellent optoelectric characteristics since the transmittance of the metallic nanowire is not decreased after the reduction reaction.

The metallic nanowire is not oxidized in the air because of the reduction treatment.

By the chemical reduction process, the oxide film disappears on the bonded side of the metallic nanowires, and the adjacent metallic nanowires are fused. Accordingly, resistance of the metallic nanowires may be substantially decreased.

Figure 4:
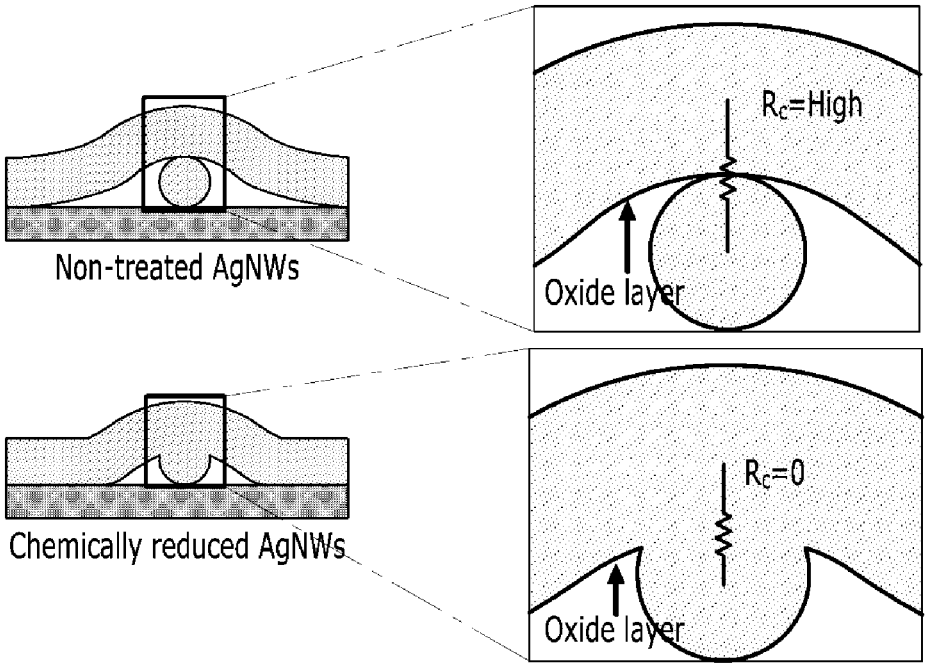
FIG. 4 shows an interface of a nanowire that is not reduced and an interface of a nanowire that is reduced.

FIG. 4 shows an interface of a nanowire that is not reduced and an interface of a nanowire that is reduced. Referring to FIG. 4, the oxide film disappears from the interface of the reduced silver nanowire (AgNW) by the reduction reaction so it is determined that resistance on the interface is decreased.

In the conventional method for manufacturing a metallic nanowire transparent electrode, a material for blocking oxygen or moisture is additionally applied so as to prevent the metallic nanowire from being oxidized, which decreases transmittance of the metallic nanowire transparent electrode. However, the method for manufacturing a metallic nanowire transparent electrode according to the present exemplary embodiment may prevent oxidiation without a loss of transmittance as a result of the chemical reduction treatment.

Figure 5:
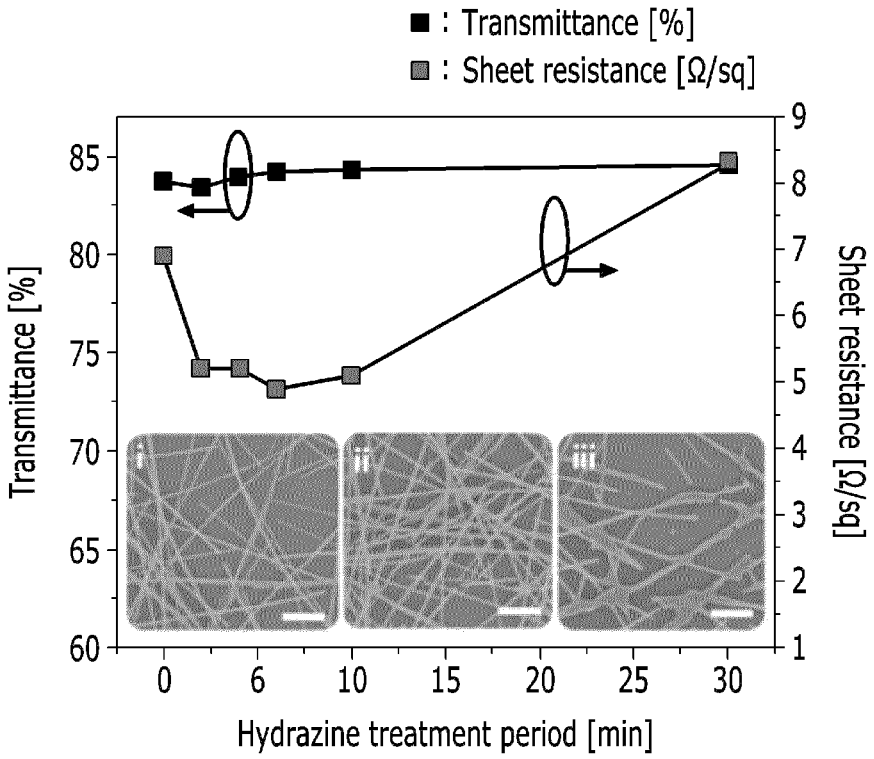
FIG. 5 shows a change of transmittance and sheet resistance with respect to a nanowire's reducing agent treatment time.

FIG. 5 shows a change of transmittance and sheet resistance with respect to a nanowire's reductant treating time. Referring to FIG. 5, it is determined that, when a time for processing a reducing agent (e.g., hydrazine) increases, transmittance gradually increases and sheet resistance decreases followed by an increase. Accordingly, as shown in FIG. 5, when the hydrazine is used as a reductant for the silver nanowire, it is determined that an appropriate processing time is about 1 min to 10 min.

Therefore, the manufacturing method according to an exemplary embodiment of the present disclosure may use the hydrazine as a reducing agent in the stage for chemically reducing the silver nanowires and connecting the adjacent silver nanowires, and a desirable processing time may be about 1 min to 10 min.

Figure 6:
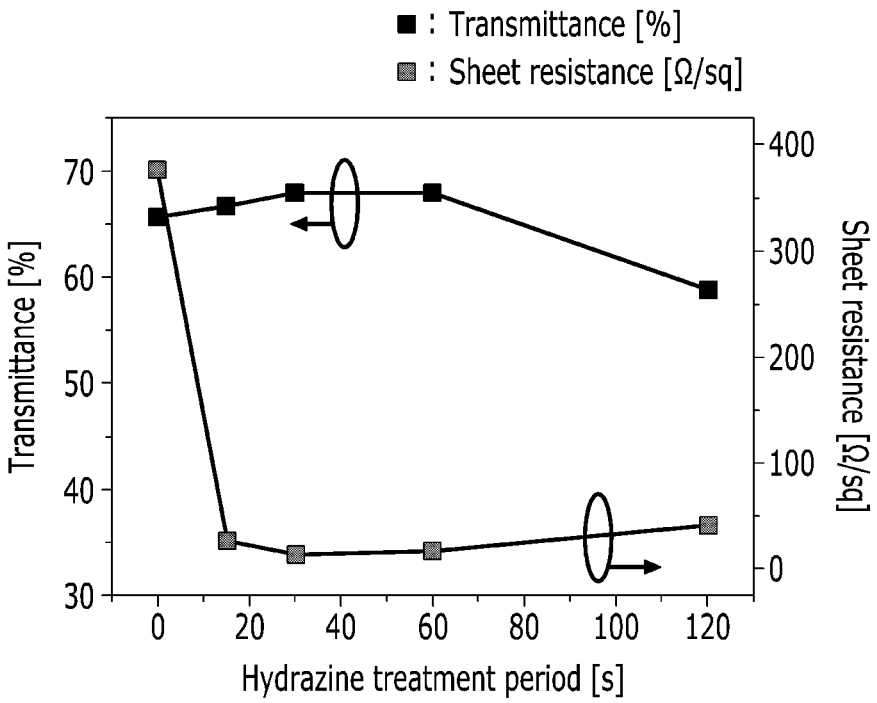
FIG. 6 shows a change of transmittance and sheet resistance with respect to a copper nanowire's reducing agent treatment time.

FIG. 6 shows a change of transmittance and sheet resistance with respect to a copper nanowire's reducing agent treating time. Referring to FIG. 6, it is determined that, when a time for processing a reducing agent (e.g., hydrazine) increases, transmittance increases followed by a decrease and the sheet resistance steeply decreases followed by a gradually increase. Accordingly, as shown in FIG. 6, when the hydrazine is used as a reducing agent for the copper nanowire, it is determined that an appropriate processing time is about 20 min to 60 min.

Therefore, the manufacturing method according to an exemplary embodiment of the present disclosure may use hydrazine as a reducing agent in the stage for chemically reducing the copper nanowires and connecting the adjacent copper nanowires, and a desirable processing time may be about 20 min to 60 min.

Next, the method for manufacturing a metallic nanowire transparent electrode according to an exemplary embodiment of the present disclosure may reproduce the metallic nanowire transparent electrode that is oxidized after its use and also has shown increased sheet resistance, by reducing the metallic nanowire transparent electrode will be described.

The method for manufacturing a metallic nanowire transparent electrode according to the present exemplary embodiment may include soaking the metallic nanowires in water and separating the substrate and the metallic nanowires deposited on the substrate (S25) after the chemical reduction step of the metallic nanowires and connecting the adjacent metallic nanowires.

When the reduction process is performed while the metallic nanowires are deposited on the substrate in the previous stage, a process for separating the substrate and the metallic nanowire is to be performed. The manufacturing method may separate the metallic nanowires and the substrate by chemical reduction of the metallic nanowires to connect them to each other, and soaking the substrate to which the metallic nanowires are attached in the water.

Figure 7:
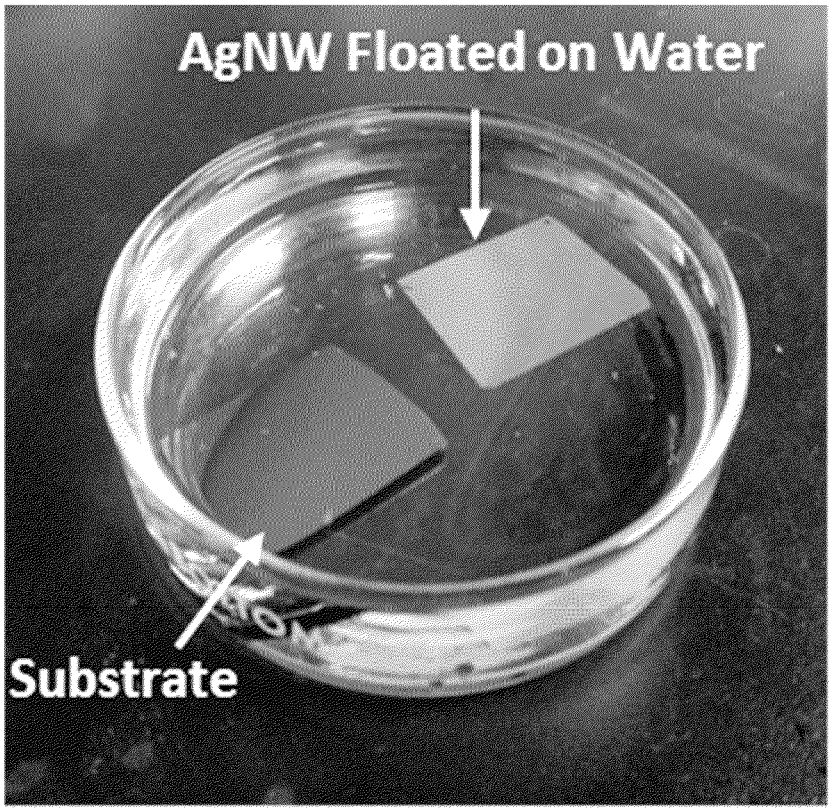
FIG. 7 shows an image for soaking a metallic nanowire in water and separating the metallic nanowire deposited to the substrate and a substrate.
Figure 8:
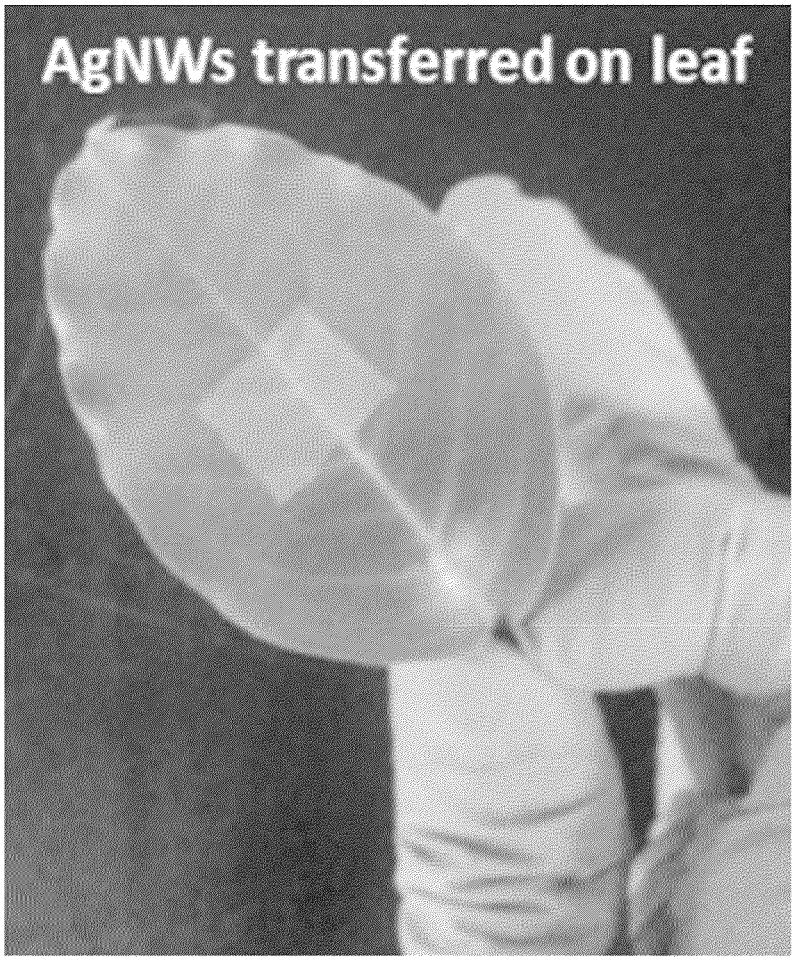
FIG. 8 to FIG. 12 show images of a metallic nanowire transparent electrode transferred to various materials according to an exemplary embodiment.
Figure 9:
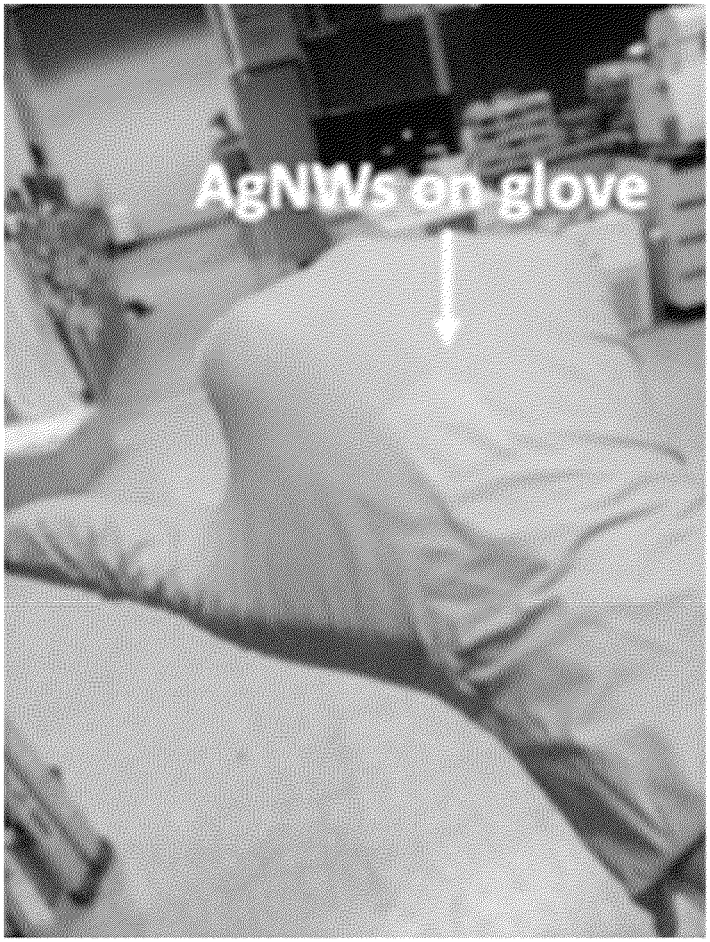
Figure 10:
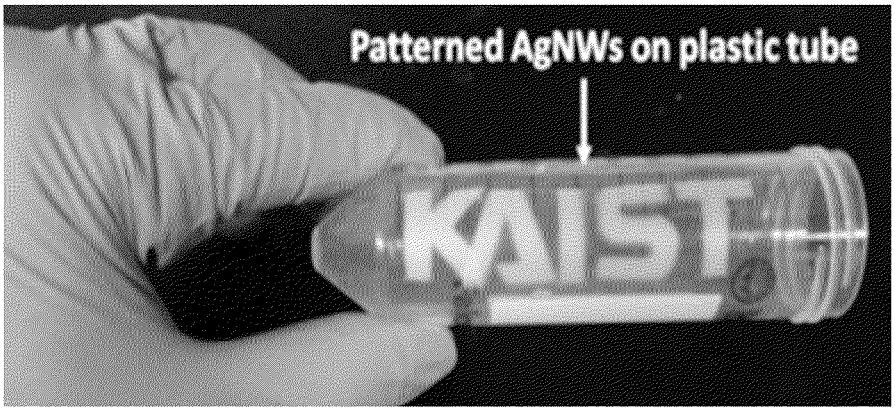

FIG. 7 shows an image for soaking a metallic nanowire in water and separating the metallic nanowire deposited to the substrate and the substrate.

Referring to FIG. 7, it is determined that when the silver nanowire electrode provided on the substrate is allowed to soak in the water, the substrate is separated from the silver nanowire electrode, and the silver nanowire electrode floats on the water.

A stage (S30) for transferring the separated metallic nanowire electrode onto a material may be further included (FIG. 1). As described, the substrate on which the metallic nanowires are deposited may be removed by soaking them in the water, and the metallic nanowires thus may be transferred onto the material, wherein the material can have a variety of industrial applications. The material may be a new matter having a property that is different from the above-noted substrate.

In some embodiments, the stage for manufacturing and reducing the metallic nanowires may use a hard substrate such as glass, separate the substrate and the metallic nanowire electrode by soaking in water like the previous stage, and transfer the metallic nanowire electrode to a substrate with various materials. For example, the metallic nanowire transparent electrode may transfer the metallic nanowire electrodes onto various kinds of flexible substrates such as plastic or an organic material, and the manufactured metallic nanowire electrodes may be used in various fields.

Figure 11:
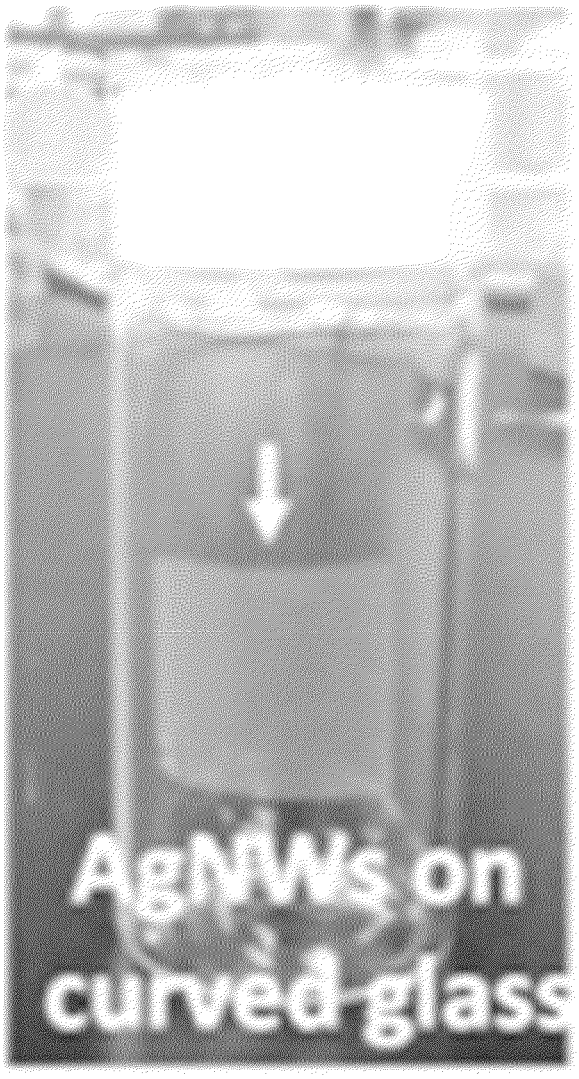
Figure 12:
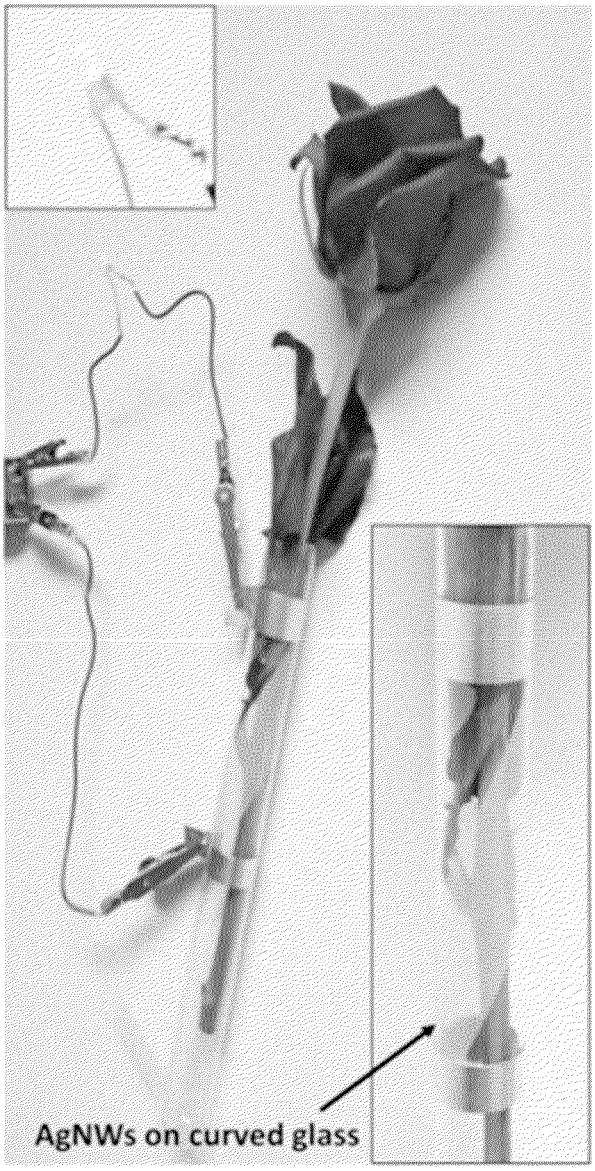

FIG. 8 to FIG. 12 show images of a metallic nanowire transparent electrode transferred to various materials according to some embodiments of the present disclosure. As can be determined through FIG. 8, the metallic nanowire transparent electrode according to the manufacturing method according to one embodiment of the present disclosure may be transferred to a leaf. The metallic nanowire transparent electrode according to the manufacturing method according to another embodiment of the present disclosure may be transferred to a wrinkled surface such as a glove (FIG. 9), a plastic tube (FIG. 10), or a curved side of a glass bottle (FIG. 11 and FIG. 12).

Therefore, the metallic nanowire transparent electrode according to the manufacturing method as disclosed in the various embodiments may be used in various industrial applications.

The transmittance of the metallic nanowire transparent electrode may be greater than about 80% in the visible ray region. Hence, an additional material is not deposited or coated for the reduction as described above so the transmittance does not decrease. The silver nanowire transparent electrode manufactured according to one embodiment of the present disclosure may have transmittance that is greater than about 93% and sheet resistance that is less than about 17 Ω/sq.

Figure 13:
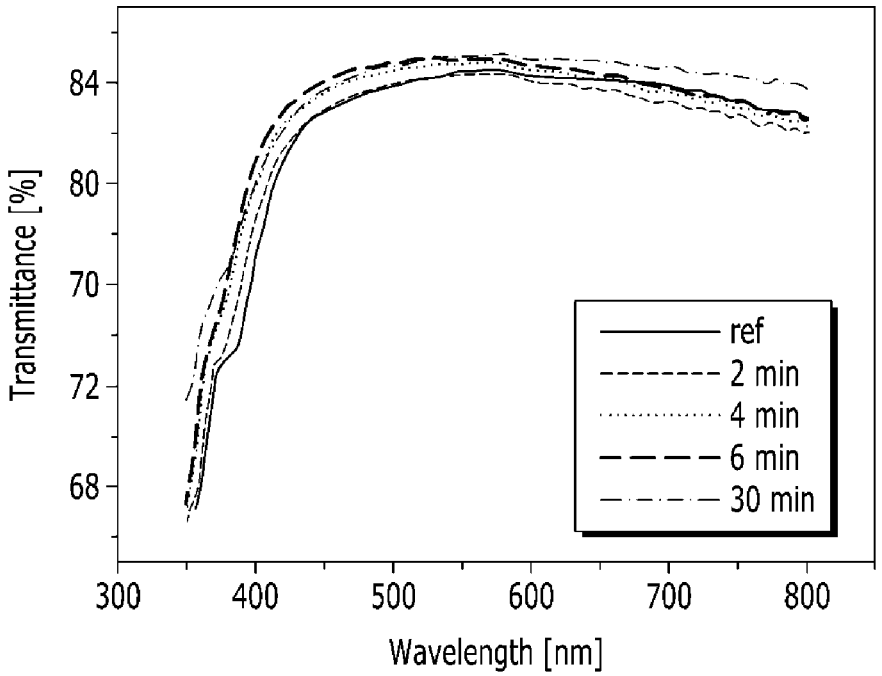
FIG. 13 shows a change of transmittance with respect to reduction time.

FIG. 13 shows a change of transmittance with respect to reduction time according to an exemplary embodiment of the present disclosure. Referring to FIG. 13, it is determined that transmittance (ref) of the metallic nanowire electrode before reduction is equal or similar to transmittance of the metallic nanowire electrode after reduction.

For example, as shown in FIG. 13, it is determined that the metallic nanowire electrode according to the manufacturing method as disclosed in one embodiment of the present disclosure shows transmittance that is greater than 80% in the visible ray region.

Figure 14:
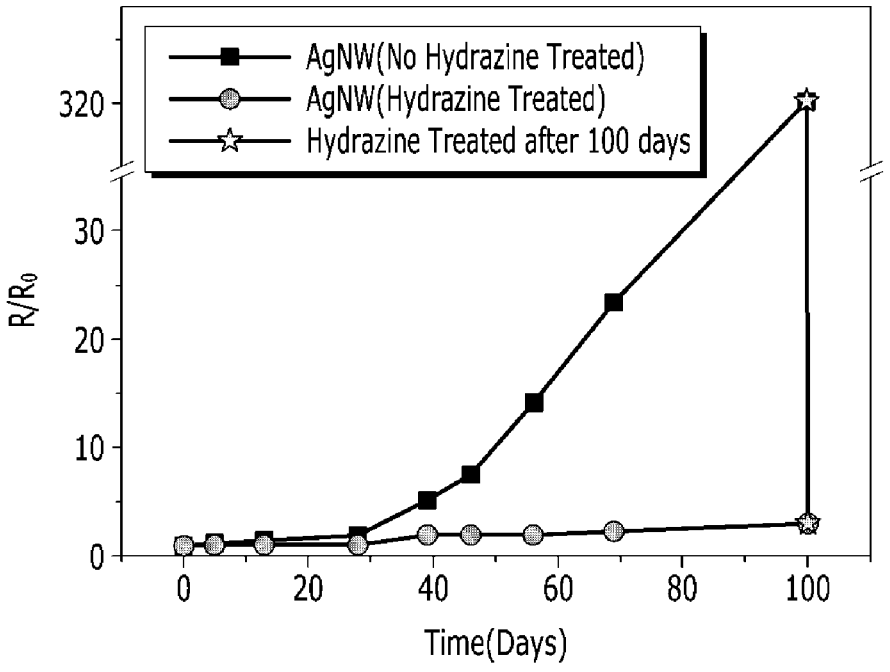
FIG. 14 shows an increase of sheet resistance of a silver nanowire that is chemically reduced and a silver nanowire that is not chemically reduced with respect to time.

FIG. 14 shows an increase of sheet resistance of a silver nanowire that is chemically reduced and a silver nanowire that is not chemically reduced with respect to time according to an exemplary embodiment of the present disclosure.

Referring to FIG. 14, it is determined that sheet resistance of the hydrazine-treated silver nanowire electrode according to an exemplary embodiment of the present disclosure does not substantially increase after 100 d.

However, it is determined that sheet resistance of the silver nanowire electrode without a hydrazine treatment according to a comparative example of the present disclosure continues to increase with respect to time.

As shown in FIG. 14, the comparative example wherein the silver nanowire electrode that has been used for 100 d and has high sheet resistance, was subjected to chemical reduction with hydrazine after 100 d, the sheet resistance of the silver nanowire electrode decreased substantially.

Therefore, the method for manufacturing a metallic nanowire transparent electrode according to an exemplary embodiment of the present disclosure may reproduce the metallic nanowire that is oxidized and has increased sheet resistance.

As described, the method for manufacturing a metallic nanowire transparent electrode according to an exemplary embodiment of the present disclosure may chemically reduce a plurality of manufactured metallic nanowires and connect them to each other to manufacture the electrode.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments. While one or more exemplary embodiments have been described with reference to the figures, it will be understood by those of ordinary skill in the art that various changes in form and details may be made therein without departing from the spirit and scope of the present disclosure as defined by the following claims.

What is claimed is:

1. A method for manufacturing a metallic nanowire transparent electrode, comprising:

generating a metallic oxide nanowire; and chemically reducing the metallic oxide nanowire to connect adjacent metallic nanowires.

2. The method of claim 1, wherein the reducing agent used when the metallic oxide nanowire is chemically reduced is at least one selected from the group consisting of hydrazine, hydroxylamine, and formaldehyde, tetrahydroborates including lithium (Li) tetrahydroborate, including sodium (Na) tetrahydroborate, potassium (K) tetrahydroborate, polyhydroxybenzenes including hydroquinone, alkyl-substituted hydroquinones, and pyrogallol, LiAlH4, phenylenediamines, aminophenols, ascorbic acid, ascorbic acid ketals, 3-pyrazolidinone, hydroxytetronic acid, hydroxytetronamide, bisnaphthols, lithium (Li), sodium (Na), and potassium (K) sulfonamidophenols.

3. The method of claim 2, wherein the metallic oxide nanowire includes at least one metal selected from the group consisting of lead (Pb), indium (In), tin (Sn), aluminum (Al), silver (Ag), copper (Cu), gold (Au), platinum (Pt), titanium (Ti), iron (Fe), nickel (Ni), cobalt (Co), and their mixtures.

4. The method of claim 3, wherein the metallic oxide nanowire includes silver, the reducing agent used when the metallic oxide nanowire is chemically reduced is hydrazine, and the reduction time is about 1 min to 10 min.

5. The method of claim 3, wherein the metallic oxide nanowire includes copper, the reducing agent used when the metallic oxide nanowire is chemically reduced is hydrazine, and the reduction time is about 20 min to 60 min.

6. The method of claim 1 wherein

The chemically reducing of the metallic oxide nanowire is performed by reacting with the metallic oxide nanowire while the reducing agent is vaporized.

7. The method of claim 1, wherein

The chemically reducing of the metallic oxide nanowire is performed by soaking the metallic oxide nanowire in the reducing agent in a solution state.

8. The method of claim 1. further comprising:

the step of depositing the metallic oxide nanowire on a substrate before generating of a metallic oxide nanowire and the chemical reduction of the metallic oxide nanowire to connect adjacent metallic nanowires.

9. The method of claim 8. further comprising,

After chemically reducing the metallic oxide nanowire to connect adjacent metallic nanowires, soaking the metallic oxide nanowire in water to separate the substrate and the metallic nanowire deposited on the substrate.

10. The method of claim 9, further co rising after soaking the metallic oxide nanowire in water to separate the substrate and the metallic oxide nanowire deposited on the substrate, transferring the separated metallic oxide nanowire on a material.

11. The method of claim 1, wherein

After chemically reducing the metallic oxide nanowire to connect adjacent metallic nanowires, transmittance of the metallic oxide nanowire transparent electrode is greater than 80% in a visible ray region.

* * * * *